US009552975B2

(12) United States Patent
Brown et al.

(10) Patent No.: US 9,552,975 B2
(45) Date of Patent: Jan. 24, 2017

(54) MASS SPECTROMETERS COMPRISING ACCELERATOR DEVICES

(71) Applicant: Micromass UK Limited, Wilmslow (GB)

(72) Inventors: Jeffery Mark Brown, Hyde (GB); Martin Raymond Green, Bowdon (GB); David J. Langridge, Macclesfield (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/131,386

(22) Filed: Apr. 18, 2016

(65) Prior Publication Data

US 2016/0233075 A1 Aug. 11, 2016

Related U.S. Application Data

(63) Continuation of application No. 14/355,884, filed as application No. PCT/GB2012/052746 on Nov. 5, 2012, now Pat. No. 9,318,309.

(60) Provisional application No. 61/556,499, filed on Nov. 7, 2011.

(30) Foreign Application Priority Data

Nov. 4, 2011 (GB) ..... 1119059.2

(51) Int. Cl.
*H01J 49/40* (2006.01)
*H01J 49/00* (2006.01)

(52) U.S. Cl.
CPC ..... *H01J 49/403* (2013.01); *H01J 49/0031* (2013.01)

(58) Field of Classification Search
USPC ..... 250/281, 282, 287
See application file for complete search history.

(56) References Cited

U.S. PATENT DOCUMENTS

| | | | |
|---|---|---|---|
| 2,896,083 | A | 7/1959 | Hare et al. |
| 3,250,949 | A | 5/1966 | Cornelis et al. |
| 4,721,854 | A | 1/1988 | Dawson |
| 5,136,161 | A | 8/1992 | Logan |
| 6,057,544 | A | 5/2000 | Ishihara |
| 6,703,608 | B2 | 3/2004 | Holle et al. |

(Continued)

FOREIGN PATENT DOCUMENTS

| | | |
|---|---|---|
| JP | 10-275589 | 10/1998 |
| JP | 2001-210267 | 8/2001 |
| JP | 2006-260873 | 9/2006 |

*Primary Examiner* — Kiet T Nguyen
(74) *Attorney, Agent, or Firm* — Diederiks & Whitelaw, PLC

(57) ABSTRACT

A method of mass spectrometry is disclosed comprising providing a flight region for ions to travel through and a detector or fragmentation device. A potential profile is maintained along the flight region such that ions travel towards the detector or fragmentation device. The potential at which a first length of the flight region is maintained is then changed from a first potential to a second potential while at least some ions are travelling within the first length of flight region. The changed potential provides a first potential difference at an exit of the length of flight region, through which the ions are accelerated as they leave the length of flight region. This increases the kinetic energy of the ions prior to them reaching the detector or fragmentation cell.

20 Claims, 4 Drawing Sheets

(56) References Cited

U.S. PATENT DOCUMENTS

| | | | | |
|---|---|---|---|---|
| 7,196,324 | B2 | 3/2007 | Verentchikov | |
| 8,389,933 | B2 | 3/2013 | Hoyes | |
| 2008/0272289 | A1* | 11/2008 | Vestal | H01J 49/025 250/287 |
| 2008/0272293 | A1* | 11/2008 | Vestal | H01J 49/164 250/288 |
| 2010/0327157 | A1* | 12/2010 | Green | H01J 49/065 250/282 |
| 2011/0174967 | A1 | 7/2011 | Kou | |
| 2012/0145889 | A1 | 6/2012 | Vestal | |
| 2013/0168547 | A1 | 7/2013 | Nishiguchi et al. | |

* cited by examiner

MASS SPECTROMETERS COMPRISING ACCELERATOR DEVICES

CROSS-REFERENCE TO RELATED APPLICATION

This application is a continuation application of U.S. patent application Ser. No. 14/355,884 filed 2 May 2014 which is the National Stage of International Application No. PCT/GB2012/052746, filed 5 Nov. 2012, which claims priority from and the benefit of U.S. Provisional Patent Application Ser. No. 61/556,499 filed 7 Nov. 2011 and United Kingdom Patent Application No. 1119059.2 filed on 4 Nov. 2011. The entire contents of these applications are incorporated herein by reference.

BACKGROUND OF THE INVENTION

The present invention relates to a mass spectrometer and a method of mass spectrometry.

Many time of flight (TOF) detector instruments employ electron multiplier detectors, such as microchannel plate detectors (MCPs) or discrete or continuous dynode detectors. A common feature of these detectors is that primary ions strike the detector, releasing secondary electrons which are guided to further electron multiplication stages. The conversion efficiency or electron yield from an ion strike to the production of secondary electrons defines the efficiency of the detector. Researchers have previously shown that the yield ($\lambda$) with which an ion generates a secondary electron in a MCP is:

$$\lambda = kmv^{4.4}$$

where m is the mass of the ion, v is the velocity of the ion, and k is a proportionality constant with a value of $10^{-24}$ and which has a unit that cancels the SI units of mass m and velocity v so as to leave a unitless efficiency $\lambda$. The strong velocity dependence of the efficiency $\lambda$, means that large mass to charge ratio ions that tend to be relatively slow produce significantly fewer ion counts than faster, smaller mass to charge ratio ions.

In conventional TOF systems where ions of charge q are accelerated through a fixed source potential $V_s$, the above equation for efficiency $\lambda$ may be rearranged and approximated as follows:

$$\lambda \sim (4q^2 V_s^2)/m$$

For many situations this yield $\lambda$ is significantly less than unity and researchers have shown that the mechanism for generating signals from high mass ions (>100 kDa) is dominated by the generation of secondary ion yield at the strike surface of the detector. These secondary ions subsequently generate electrons at the next strike surface within the detector. It is therefore apparent that the problem of poor detector efficiency becomes severe when singly charged, high mass to charge ratio ions are analysed. This is a common problem, for example, when analysing large proteins or polymers using matrix assisted laser desorption ionization (MALDI). The detector efficiency may also become a dominant problem for time of flight (TOF) instruments having low acceleration potentials.

In order to maximize the yield of electrons or secondary ions, and hence maximise detector efficiency, many TOF mass spectrometers employ high accelerating voltages so that ions reach the detector with high kinetic energy. In such arrangements, the ions enter the acceleration region at or near ground potential and are then accelerated using high voltages so as to have thousands of electron volts of energy. In order to achieve this the strike surface of the ion detector is held at high potential with respect to the ground potential. In order to allow operation with both positive and negative ions the output of the ion detector is also held at a high voltage. The signals output from the ion detector are generally recorded using time to digital converters (TDCs) or analogue to digital converters (ADCs). However, high speed state of the art TOF system recording electronics operate at or near ground potential and are often sensitive to high voltages. It is therefore a common requirement to isolate the high voltage applied to the output of the ion detector from the ADC or TDC, whilst at the same time allowing the signal arising from the arrival of ions at the detector to be transferred with high fidelity. This may be achieved using capacitive coupling or optical coupling. However, the higher the voltage that is isolated, the more difficult it becomes to provide effective isolation without compromising the fidelity of the ion signal.

In some TOF instruments a post acceleration detector (PAD) is used to increase the detection efficiency for low velocity or low energy ions. In this type of detector ions are accelerated onto a separate conversion dynode and the secondary ions and/or electrons generated therefrom are then accelerated to the strike surface of an electron multiplier. As the secondary charged species formed at the conversion dynode are generally of low mass to charge ratio, their velocity may be significantly higher than the velocity of the primary ion and therefore the efficiency of the detection is increased. However, this approach has the disadvantage that the time response of the detector may be many orders of magnitude slower than in normal operation, which can severely compromise the performance of the mass spectrometer. PAD detectors are therefore commonly used to enhance the efficiency for very high mass to charge ratio species where loss of instrument resolution may be an acceptable compromise. PAD detectors are also employed in mass spectrometers that use low ion acceleration voltages.

It is desired to provide an improved mass spectrometer and method of mass spectrometry.

SUMMARY OF THE INVENTION

According to the present invention there is provided a method of mass spectrometry comprising:

providing a flight region for ions to travel through and a detector;

maintaining a potential profile along the flight region such that ions travel towards the detector;

changing the potential at which a first length of the flight region is maintained from a first potential to a second potential whilst at least some ions are travelling within said first length of flight region, the changed potential providing a first potential difference at an exit of said length of flight region, whereby said at least some ions are accelerated through the potential difference as they leave said length of flight region.

The invention allows the energy of the ions incident on the detector to be increased by changing the potentials applied to components of the mass spectrometer during the flight of the ions. As the efficiency of the detector is preferably proportional to the kinetic energy of the ions that impact on the detector, this increase in ion energy results in higher ion detection efficiency. This is particularly useful for ions having a high mass to charge ratio and low charge state, which tend to have low kinetic energy in conventional detection techniques. The present invention also allows the kinetic energy of the ions to be increased whilst minimizing any impact on the high voltage isolation or decoupling requirements of the mass spectrometer detection system.

Preferably, the potential at which the first length of flight region is maintained is changed relative to the potential at which the detector is maintained so as to provide the potential difference between the first length of flight region and the detector. Alternatively, the potential at which the first length of flight region is maintained may be changed relative to the potential at which a second downstream length of said flight region is maintained so as to provide the potential difference between the first and second lengths of flight region.

Preferably, the at least some ions are accelerated through the potential difference so as to arrive at the detector with increased kinetic energy. This may improve the detection efficiency of the ions.

Ions having a range of different mass to charge ratios are preferably passed into the flight region and separate spatially according to mass to charge ratio as they travel towards the detector. In this method, the potential of the first length of flight region is preferably varied with time such that the potential difference is set to be relatively small or no potential difference whilst ions of relatively low mass to charge ratio pass through and exit the first length of flight region, and such that the potential difference is set to be relatively high when ions of relatively high mass to charge ratio pass through and exit the first length of flight region.

The method may comprise changing the potential at which the first length of flight region is maintained from the second potential to a third potential whilst ions are travelling within said first length of flight region, the changed potential providing a second potential difference at an exit of the first length of flight region, whereby ions are accelerated through the second potential difference as they leave the first length of flight region. Preferably, the second potential difference is greater than the first potential difference. It is preferred that the potential of the first length of flight region is varied with time such that the first potential difference is set to be relatively small whilst ions of relatively low mass to charge ratio pass through and exit the first length of flight region, and such that the second potential difference is set to be relatively high when ions of relatively high mass to charge ratio pass through and exit the length of flight region.

The method may comprise providing an ion mirror in the flight region such that ions travel in a first direction through the first length of flight region and to a first end of the first length of flight region as they travel towards the ion mirror, and wherein the ions travel through the first length of flight region in a second direction and to a second end of the first length of flight region after having been reflected by the mirror and on the way towards the detector. In this method, the step of changing the potential at which the first length of the flight region is maintained may provide the first potential difference at the second end of the first length of flight region. The ions are reflected by the ion mirror so that they travel through the first length of flight region in the second direction, and the ions are then accelerated through the first potential difference as they leave said first length of flight region through the second end and travel towards the detector. According to the methods in which the potential at which the first length of the flight region is maintained is changed from the second potential to the third potential, the method may further comprise changing the potential from the second potential to the third potential whilst ions are travelling within said first length of flight region in the second direction. The changed potential provides a second potential difference at the second end of said first length of flight region, whereby the ions are accelerated through the second potential difference as they leave the first length of flight region through the second end and travel towards the detector.

Preferably, the method further comprises changing the potential at which a further length of the flight region is maintained whilst at least some ions are travelling within said further length of flight region. The further length of flight region is in a different axial position of the flight region to the first length of flight region and the changed potential of this length results in a further potential difference being arranged at the exit of the further length of flight region. At least some ions are accelerated through this further potential difference as they leave the further length of flight region. Although only one further length of flight region has been described, it will be appreciated that more than one further length of flight region may be provided.

The timings at which the potentials applied to the first and further lengths of flight region are changed may be selected such that the ions accelerated by the first potential difference at the exit of the first length of flight region are different to the ions that are accelerated by the further potential difference at the exit of the further length of flight region. Alternatively, the timings at which the potentials applied to the first and further lengths of flight region are changed may be selected such the same ions are accelerated by the first potential difference at the exit of the first length of flight region and by the further potential difference at the exit of the further length of flight region.

Preferably, the first length of flight region is defined by a first group of electrodes, wherein a first potential is applied to each of the electrodes that is the same for each electrode, and wherein said step of changing the potential at which the first length of flight region is maintained comprises applying a potential to each of the electrodes that is the same for each electrode and that is different to said first potential.

Preferably, the further length of flight region is defined by a further group of electrodes, wherein a second potential is applied to each of the electrodes that is the same for each electrode, and wherein said step of changing the potential at which the further length of flight region is maintained comprises applying a potential to each of the electrodes that is the same for each electrode and that is different to said second potential.

The method may comprise providing the first length of flight region adjacent to the further length of flight region with an acceleration region arranged therebetween, applying a first phase of an RF voltage supply to the electrodes of the first length of flight region and a second phase of the RF voltage supply to the electrodes of the further length of flight region such that whilst ions are travelling within the first length of flight region the potential of the first length of flight region is increased by the RF voltage supply and the ions exit the first length of flight region when the RF voltage supply provides a potential difference between the first and further lengths of flight region so as to cause the ions to be accelerated through the acceleration region and into the further length of flight region. After the ions have entered the further length of flight region the RF voltage supply preferably increases the potential of the further length of flight region and provides the further potential difference at the exit of the further length of flight region for accelerating the ions when they exit the further length of flight region. Preferably, the frequency of the RF voltage supply is selected based on the mass to charge ratio of ions that are desired to be accelerated.

Axially spaced electrodes may be arranged along the axial length of the flight region and DC potentials may be applied to these electrodes so as to create a DC axial field that exerts a force on ions in an axial direction that is opposite to the direction in which the ions are accelerated by the potential difference(s). The potential of the first length of flight region and/or the potential of the further length of flight region may be varied with time so as to accelerate ions of a selected range of mass to charge ratios through the first and/or further potential difference in one direction, and ions having other mass to charge ratios may be driven in another direction by the DC axial field.

Axially spaced electrodes may be arranged along the axial length of the flight region and RF voltages may be applied to these electrodes in the first length of flight region and/or in the further length of flight region and/or between the first and further lengths in order to radially confine ions.

Preferably, the first and/or further length of flight region is a field free region, and the step of changing the potential at which this length of the flight region is maintained comprises maintaining the length as a field free region. Alternatively, an axial voltage gradient may be arranged along the first and/or further length of flight region, and changing the potential at which this length of the flight region is maintained may comprise changing the magnitudes of the voltages forming the voltage gradient whilst maintaining the voltage gradient constant.

Preferably, the step of changing the potential of the first and/or further length of flight region whilst ions travel therethrough increases the potential energy of the ions without increasing their kinetic energy as the ions travel therethrough.

Preferably, the ion detector is maintained at a constant potential whilst the potential applied to the first and/or further length of flight region is changed.

The length of the first and/or further length of flight region may be selected from the group consisting of: >2 mm; >4 mm; >8 mm; >10 mm; >20 mm; >40 mm; >60 mm; >80 mm; >100 mm; >150 mm; >300 mm; > and 600 mm.

Preferably, the method is a method of time of flight mass spectrometry. Such a method further comprises providing the flight region between an acceleration electrode and the detector, wherein ions are accelerated into the flight region by applying a voltage pulse to the acceleration electrode. Preferably, the ions have substantially no velocity in the direction of time of flight until they are accelerated into the flight region by the acceleration electrode.

Preferably, only parent ions and no fragment ions are accelerated through the potential difference as they leave the first and/or further length of flight region; or only fragment ions and no parent ions are accelerated through the potential difference as they leave the first and/or further length of flight region.

The present invention also provides a mass spectrometer comprising:

a flight region for ions to travel through;

a detector; and control means arranged and adapted to:

maintain a potential profile along the flight region such that, in use, ions travel towards the detector; and change the potential at which a first length of the flight region is maintained from a first potential to a second potential whilst at least some ions are travelling within said first length of flight region, the changed potential providing a first potential difference at an exit of said length of flight region, whereby said at least some ions are accelerated through the potential difference as they leave said length of flight region.

The mass spectrometer may be arranged and adapted to perform any one or combination of the above-described methods of mass spectrometry.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; and (xxi) an Impactor ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The preferred embodiment of the present invention relates to an improvement to a conventional time of flight instrument in which the efficiency of the ion detector depends on the energy and/or velocity of the ions incident thereon. The preferred embodiment allows the energy of the ions incident on the detector to be increased by changing the potentials applied to components of the time of flight mass spectrometer during the flight time of the ions. As the yield of secondary electrons at the detector is proportional to the kinetic energy of ion impact, this increase in energy results in higher ion detection efficiency. This is particularly advantageous for ions having a high mass to charge ratio and a low charge state, as these ions conventionally have a low kinetic energy and hence a low ion detection efficiency. For example, such ions having a very high mass and being singly charged may be produced using matrix assisted laser desorption ionisation (MALDI). The preferred embodiment therefore improves the overall efficiency of the detector, particularly for time of flight instruments employing low acceleration potentials and/or when analyzing ions of high mass to charge ratio which have relatively low velocity and hence low detection efficiency.

In conventional time of flight spectrometers, the energy of the ions at the primary strike surface of the detector is governed by the difference in potential from the initial acceleration electrode to the primary strike surface of the detector. In contrast, in the preferred embodiment of the present invention the energy of the ions at the detector primary strike surface is increased by changing the potentials applied to specific regions of the analyser whilst ions are in flight. The preferred embodiment therefore allows the kinetic energy of the ions to be increased whilst minimizing any impact on the high voltage isolation or decoupling requirements of the mass spectrometer and detection system.

Although preferred embodiments have been described in relation to time of flight spectrometers it will be appreciated that the present invention is useful in other types of mass spectrometer.

From another aspect the present invention provides a method of mass spectrometry comprising:

providing a flight region for ions to travel through and a fragmentation device;

maintaining a potential profile along the flight region such that parent or precursor ions travel towards the fragmentation device; and changing the potential at which a first length of the flight region is maintained from a first potential to a second potential whilst at least some of said ions are travelling within said length of flight region, the changed potential providing a first potential difference at an exit of said length of flight region, whereby said at least some ions are accelerated through the potential difference as they leave said length of flight region and such that the ions reach the fragmentation device with increased energy and fragment therein.

This method of mass spectrometry may comprise any one or combination of features described above in relation to the method of mass spectrometry in which the ions are accelerated so as to reach the ion detector with increased energy, except wherein the ion detector is replaced by the fragmentation device.

The fragmentation device may be a gas filled collision cell or a device for enabling surface induced dissociation.

From another aspect the present invention provides a mass spectrometer comprising:

a flight region for ions to travel through in use;

a fragmentation device; and control means arranged and adapted to:

maintain a potential profile along the flight region such that, in use, parent or precursor ions travel towards the fragmentation device; and change the potential at which a first length of the flight region is maintained from a first potential to a second potential whilst at least some of said ions are travelling within said length of flight region, the changed potential providing a first potential difference at an exit of said length of flight region, whereby said at least some ions are accelerated through the potential difference as they leave said length of flight region and such that the ions reach the fragmentation device with increased energy and fragment therein.

This mass spectrometer may be arranged and adapted to perform any one or combination of the above-described methods of mass spectrometry in which the ions are accelerated so as to reach the ion detector with increased energy, except wherein the ion detector is replaced by the fragmentation device.

This mass spectrometer may comprise any one or combination of features described above in relation to the mass spectrometer in which the ions are accelerated so as to reach the ion detector with increased energy, except wherein the ion detector is replaced by the fragmentation device.

It will also be appreciated that the presently disclosed method of accelerating ions can be used to accelerate ions to regions of a mass spectrometer other than to the detector or a fragmentation device.

Accordingly, the present invention also provides a method of mass spectrometry comprising:

providing a flight region for ions to travel through;

maintaining a potential profile along the flight region such that ions travel through it; and changing the potential at which a first length of the flight region is maintained from a first potential to a second potential whilst at least some ions are travelling within said first length of flight region, the changed potential providing a first potential difference at an exit of said length of flight region, whereby said at least some ions are accelerated through the potential difference as they leave said length of flight region.

This method of mass spectrometry may comprise any one or combination of features described above in relation to the method of mass spectrometry in which the ions are accelerated so as to reach the ion detector with increased energy, except wherein the ions are accelerated to a region of the mass spectrometer other than the ion detector.

From another aspect the present invention provides a mass spectrometer comprising:

a flight region for ions to travel through; and control means arranged and adapted to:

maintain a potential profile along the flight region such that, in use, ions travel through it; and change the potential at which a first length of the flight region is maintained from a first potential to a second potential whilst at least some ions are travelling within said first length of flight region, the changed potential providing a first potential difference at an exit of said length of flight region, whereby said at least some ions are accelerated through the potential difference as they leave said length of flight region.

This mass spectrometer may be arranged and adapted to perform any one or combination of the above-described methods of mass spectrometry in which the ions are accelerated so as to reach the ion detector with increased energy, except wherein the ions are accelerated to a region of the mass spectrometer other than the ion detector.

BRIEF DESCRIPTION OF THE DRAWINGS

Various embodiments of the present invention will now be described, by way of example only, and with reference to the accompanying drawings in which:

FIG. 1A shows a potential energy diagram of an orthogonal acceleration reflection time of flight mass analyzer as operated in a conventional manner, whereas

DETAILED DESCRIPTION OF THE PREFERRED EMBODIMENTS

A time of flight (TOF) mass spectrometer operating in positive ion mode and having a two stage acceleration region and a two stage reflectron or ion mirror will now be described. However, it is also contemplated that the present invention may be applied to negative ion operation and to many other geometries of instrument.

Figure 1A:
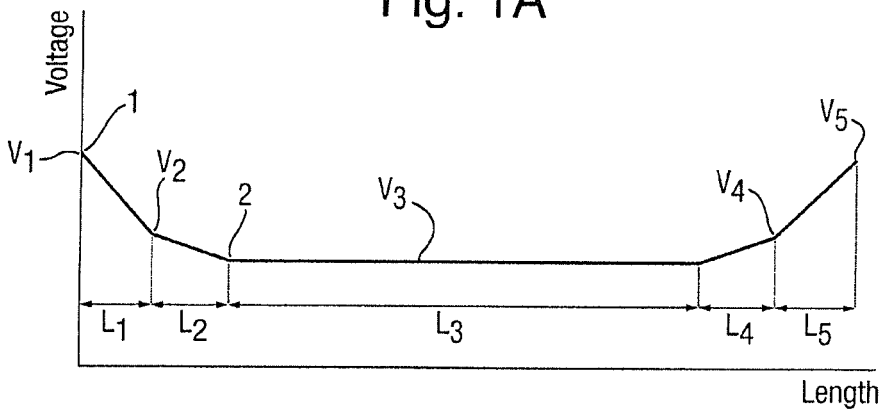

FIG. 1A shows a potential energy diagram of an orthogonal acceleration reflection TOF mass analyzer when being operated in a conventional manner. The diagram represents the relative potentials applied to the fixed electrodes within the TOF mass analyser. The potentials applied to the electrodes in FIG. 1A and the distance between these electrodes are as follows:

$V_1$=2322.2 V $V_2$=0 V $V_3$=−627.8 V $V_4$=1641.2 V $V_5$=2322.2 V $L_1$=2.7 mm $L_2$=18 mm $L_3$=711 mm $L_4$=112 mm $L_5$=56.9 mm

This geometry provides third order spatial focusing for a 1 mm wide beam of ions, resulting in a theoretical mass resolution of approximately 30,000 FWHM.

The operation of the mass analyser will now be described. Ions start in position 1 with substantially zero kinetic energy in the direction of time of flight analysis. At time $T_0$ ions begin to accelerate through the two stage acceleration region and continue to accelerate over a distance $L_1+L_2$, experiencing a total potential drop of $V_1-V_3$ (i.e. 2950 V). The total kinetic energy of an ion, $qE_{tot}$ (in eV), on entering into the field-free flight tube region of length $L_3$ is given by:

$$qE_{tot} = q(V_1 - V_3) = \frac{1}{2}mv^2 \quad (1)$$

where q=number of charges on the ion, m=the mass of the ion and v=the velocity of the ion.

In this example, a singly charged positive ion will have a kinetic energy of 2950 eV on entering the field-free region $L_3$. The ions then travel through field-free region $L_3$ and enter the two stage reflectron or ion mirror. The kinetic energy of the ions is reduced to zero over the distance of the ion mirror, i.e. $L_4$ and $L_5$. The ions are then reflected back towards their starting position and are reaccelerated over distance $L_4$ and $L_5$ such that the ions obtain the kinetic energy given in equation 1 above. The ions then re-enter the field-free drift region $L_3$ and are incident on the ion detector at position 2 with a kinetic energy given by equation 1.

The potential at the input of the ion detector, $V_{in}$, is equal to $V_3$. A voltage $V_d$ is applied across the detector itself and so the potential at the output of the ion detector, $V_{out}$, is equal to $V_3+V_d$. A state of the art micro-channel plate detector may operate, for example, with a bias voltage of +2000 V. In this example, wherein $V_3$ is approximately −628 V, the potential at the output of the detector is +1372 V. This potential at the output of the detector must be decoupled from the signal before it is recorded with a downstream analogue to digital converter (ADC) or time to digital converter (TDC), which has an input at ground potential.

Figure 1B:
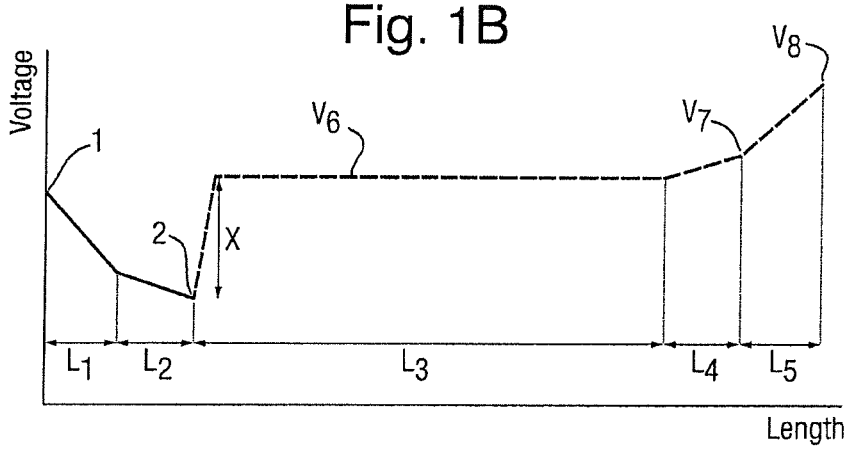
FIGS. 1B and 1C show potential energy diagrams at different times when the mass analyser is operated according to an embodiment of the present invention.

FIG. 1B shows a first embodiment of the invention, in which the potential energy profile of FIG. 1A is adapted after a time $T_1$, where $T_1>T_0$. As described in relation to FIG. 1A, at time $T_0$ ions are accelerated from position 1 through acceleration regions $L_1$ and $L_2$. The ions then enter the field-free region $L_3$ with a kinetic energy given by equation 1 above. At time $T_1$ ions of a mass to charge ratio range M1 to M2, where M2>M1, have left regions $L_1$ and $L_2$ but have not yet reached the ion detector 2. For example, at a time $T_1$=7.8 μs ion of mass to charge ratio >30,000 will have just entered region $L_3$ and ions of mass to charge ratio <7 will have just reached the detector at position 2.

At time $T_1$, while ions within the mass to charge ratio range M1 to M2 are travelling through regions $L_3$, $L_4$ and $L_5$, the potentials applied to the electrodes in these regions are rapidly increased, as indicated by the dotted line in FIG. 1B. The potentials $V_3$, $V_4$ and $V_5$ have increased by an amount X to potentials $V_6$, $V_7$ and $V_8$ respectively. As a consequence of this change the potential energies of the ions increases, although the kinetic energy remains the same. As the potential applied to the strike surface of the detector 2 remains constant but the potentials $V_6$, $V_7$ and $V_8$ increase, ions will be accelerated onto the detector as they travel towards the detector from region $L_3$. In order to maintain adequate performance, a field defining grid may be positioned in proximity to the detector input so as to limit penetration of the electric field at the input of the ion detector into region $L_3$.

As described above, if the ions within regions $L_3$, $L_4$ and $L_5$ are allowed to reach the detector they will be accelerated onto the detector strike surface. The total kinetic energy of the ions at the detector, $E1_{tot}$ (in eV), will then be given by:

$$qE1_{tot} = q(V_1 - V_3 + X) = \frac{1}{2}mv^2 \quad (2)$$

By way of example, if each of the potentials $V_3$, $V_4$ and $V_5$ is increased by X=5000 V then a singly charged positive ion with a mass to charge ratio value between 7 and 30,000 will strike the detector with a kinetic energy of 7950 eV. Ions of mass to charge ratio 7 will have a flight time to the detector of 7.8 μs and ions of mass to charge ratio 30,000 will have a flight time to the detector of 512 μs. It will be appreciated that this embodiment allows the ions to be accelerated onto the detector so as to increase the ion detection efficiency, but without changing the potential at the primary strike surface of the detector 2. This results in ions being detected more efficiently without more demanding requirements for coupling the detector to the acquisition system (e.g. ADC or TDC).

Figure 1C:
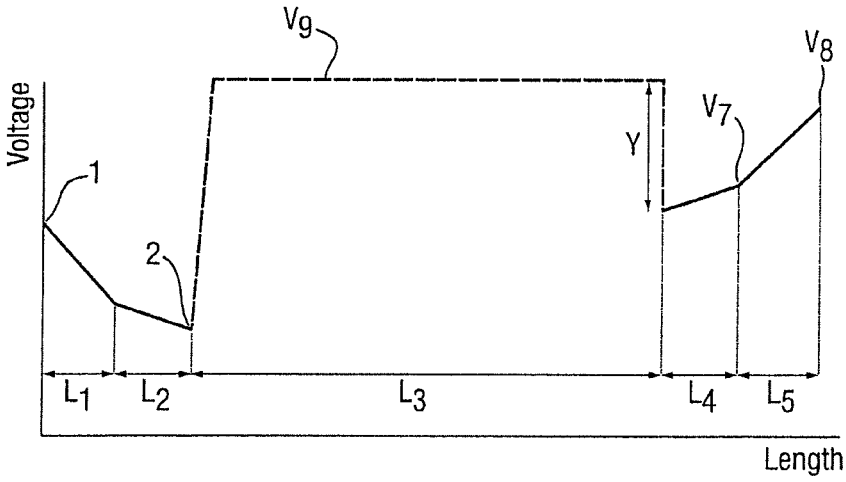

A further increase in the kinetic energy of ions may be realised according to the embodiment of the invention shown in FIG. 1C. According to this method, the potentials applied to the electrodes are not maintained fixed after time $T_1$ as shown in FIG. 1B. Rather, the potentials are initially varied as described above with respect to FIG. 1B, but after a time $T_2$ when ions of mass to charge ratio within range M3 to M4 (where M3<M4) have exited the reflectron region $L_4$ and $L_5$ and have re-entered region $L_3$, the potential applied to the electrodes in region $L_3$ is further increased as shown by the dotted line in FIG. 1C by an amount Y. This again increases the potential energy of the ions having a mass to charge ratio between M3 and M4 and that are within region $L_3$. Using the same example geometry as described above, ions of mass to charge ratio 30,000 will exit the reflectron region $L_4$ and $L_5$ and will enter the region $L_3$ at time $T_2$=349 μs. At this time ions of mass to charge ratio 14,000 will have just passed through region $L_3$ and reached the detector at position 2.

If the ions of mass to charge ratio values M3 to M4 within region $L_3$ at time $T_2$ are allowed to reach the detector they will be accelerated onto the detector strike surface with a total energy, $E2_{tot}$ (in eV), given by $$qE2_{tot} = q(V_1 - V_3 + X + Y) = \frac{1}{2}mv^2 \quad (3)$$

If the voltage applied to region $L_3$ is increased from $V_6$ to $V_9$ by an amount Y=5000 V, then in this example a singly charged positive ion with a mass to charge ratio value between 14,000 and 30,000 will strike the detector with a kinetic energy of 12950 eV. The energy of the ions within the mass to charge ratio range M3 to M4 has therefore increased by a factor of 4.4 as compared to the conventional method described in relation to FIG. 1A, leading to a proportional increase in the efficiency of ion to electron conversion at the detector.

It will be appreciated that a range of mass to charge ratios that is wider than M3 to M4 could be accelerated to a kinetic energy of 12950 eV according to the method of FIG. 1B by increasing potentials $V_3$, $V_4$ and $V_5$ by X=10,000 V at time $T_1$ to $V_6$, $V_7$ and $V_8$. However, an advantage of using multiple pluses at lower voltages, as shown in the combined methods of FIGS. 1B and 1C, is that the cost and power requirements of the voltage pulse electronics are reduced. Another advantage is that the absolute maximum potential applied to the electrodes can be minimized, thereby simplifying high voltage isolation requirements.

According to the methods described in relation to FIGS. 1B and 1C, the spatial focusing condition and the time of flight of the ions is not significantly changed for ions within the mass to charge ratio regions indicated. Ions with other mass to charge ratio values may not reach the detector or may be defocused. In addition, ions which are near to the edges of the regions that are increased in voltage at time $T_1$ or $T_2$ may be defocused due to the finite rise time of the high voltage pulses X and Y. The preferred methods may therefore increase the detection efficiency for a specific range of mass to charge ratios. It may be desirable to pre-select this range of mass to charge ratios, for example, by using a mass filter arranged upstream of the TOF analyser that only transmits ions within this mass range into the analyser. The range of mass to charge ratios that is detected with increased detection efficiency may be selected by changing the time $T_1$ and/or $T_2$ at which the voltage changes occur.

Pulse power supplies suitable for the preferred embodiments are already commercially available. For example, a state of the art +/−10,000 V pulse generator such as the model PVX4110 (Directed Energy Incorporated, Fort Collins Colo. USA) is capable of providing a 200 ns wide, 0 to 10,000 V pulse at 10 KHz with a rise and fall time of 60 ns.

It would be clear to one skilled in the art that geometries, potentials and timings other than those described above may be envisaged without departing from the scope of the invention, as defined in the appended claims.

Figure 2A:
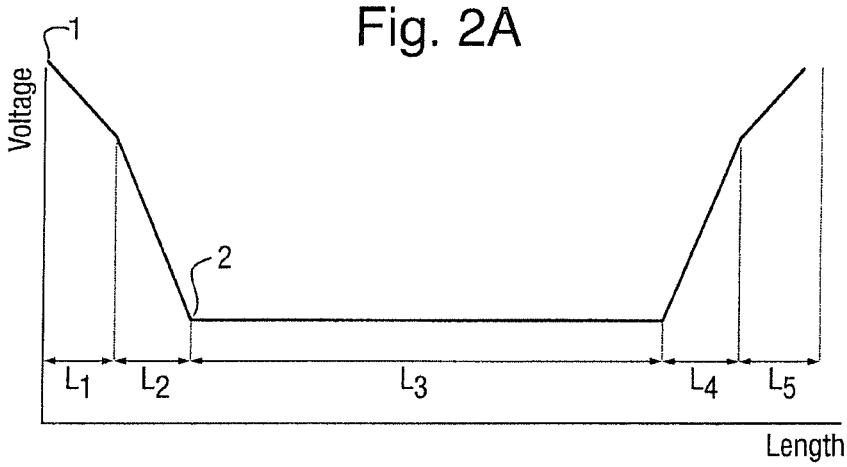
FIGS. 2A-2C show potential energy diagrams of an orthogonal acceleration reflection time of flight mass analyzer as operated in another embodiment of the present invention.
Figure 2B:
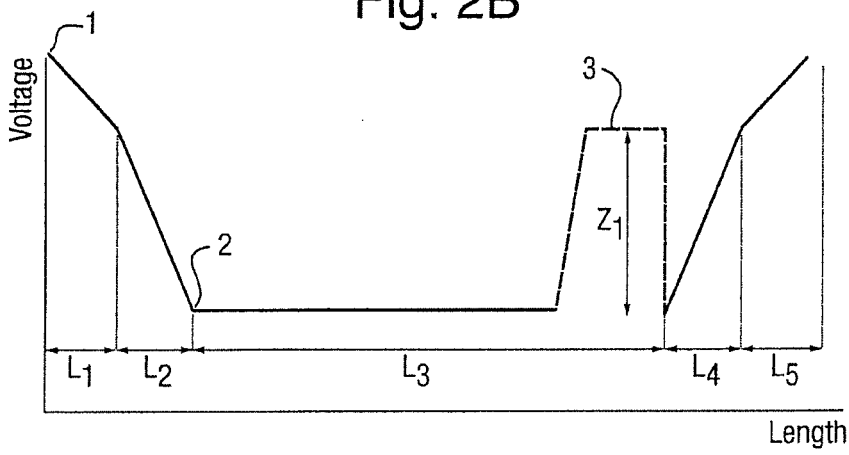
Figure 2C:
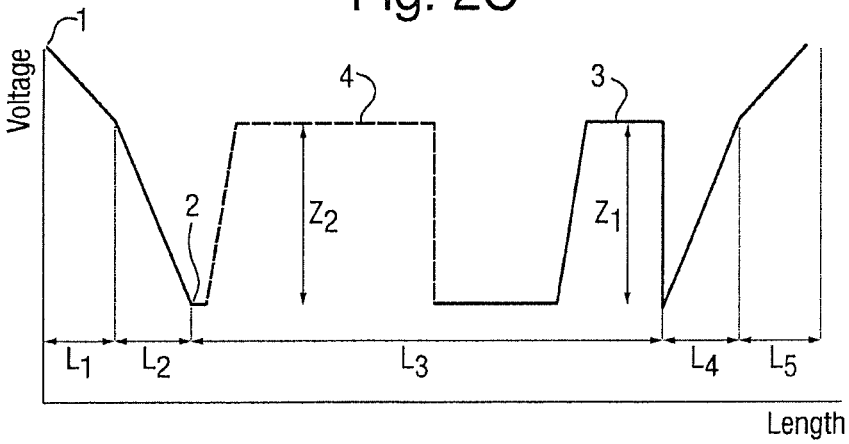

FIGS. 2A to 2C show another embodiment of the present invention. FIG. 2A shows the potential energy profile at time $T_0$ when ions are initially accelerated by acceleration regions $L_1$ and $L_2$. In the same manner as described above in relation to FIG. 1A, the ions pass from region $L_2$ into field-free region L3 with a kinetic energy given by equation 1. At a later time $T_1$ ions having a range of mass to charge ratios between M5 and M6 (where M5<M6) have traversed regions $L_1$, $L_2$, $L_3$, $L_4$ and $L_5$, have been reflected back towards the detector and have then re-entered region $L_3$, but have not yet reached the ion detector at position 2. While these ions are travelling through a section of region $L_3$ the potential of this section is raised by an amount $Z_1$, as indicated by the dotted line 3 in FIG. 2B. After a short time period all or some of the ions within the mass to charge ratio range M5 to M6 experience an accelerating potential equal to $Z_1$ as they leave the section of region $L_3$ having the increased potential, thus increasing the kinetic energy of these ions by an amount $Z_1$ eV. These ions having increased energy may then be detected by the detector with a higher detection efficiency than they would have been. However, more preferably, these ions are accelerated again before being detected, as described below.

After the ions have been accelerated by potential $Z_1$ they may travel through a second section of region $L_3$. As the ions travel through this section of region $L_3$, at a time $T_2$, the potential of this section may be increased by $Z_2$ V as shown by the dotted line 4 in FIG. 2C. As the ions leave the second section of region $L_3$ the ions are accelerated again towards the input of the ion detector. The total energy of the ions that reach the detector will therefore have increased by $Z_1+Z_2$ eV.

Although the ions have been described as being accelerated twice by increasing the potentials of various section of region $L_3$, it will be appreciated that it is possible to perform additional stages of acceleration by increasing the potentials applied to additional sections of region $L_3$ or other regions, resulting in much higher ion impact energy at the detector and consequently a further improved detector efficiency. This method has the advantage that a large increase in kinetic energy may be realised using multiple post-acceleration stages and by using only moderate voltage amplitudes to achieve the acceleration. In order to realise the multiple sections, region $L_3$ may be divided into several independent sections which may each be demarked by electric field defining grids.

In the method described in relation to FIGS. 2B and 2C, preferably only ions having a selected range of mass to charge ratios have their kinetic energy increased at any one time by each section. This is achieved by selecting the times at which the potentials of the sections are raised so as to correspond with times that the desired ions enter the sections. It is advantageous that for the analysis of ions of very high masses (e.g. >100 kDa up to and beyond the mega-Dalton or even giga-Dalton range), very high energies are provided to the ions for their detection. Multiple sections may therefore be provided for accelerating these ions to kinetic energies of many tens or hundreds of keV. In order to improve the detection efficiency over a wider range of mass to charge ratios, ions of different ranges of mass to charge ratios may be accelerated at different times by the sections. The times at which the potential of a section is raised may be synchronized to the times at which different ranges of mass to charge ratio ions are within the section. Different ranges of mass to charge ratio ions can therefore be accelerated by each section at different times. The different mass to charge ratio ranges are then detected with increased detection efficiency and the resulting mass spectral can be combined to form a composite full mass range TOF spectrum.

Figure 3:
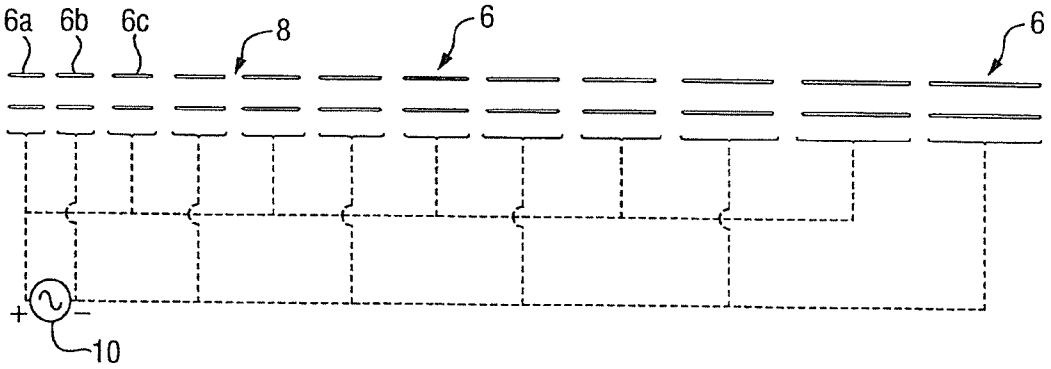
FIG. 3 is a schematic of the electrode structure of a preferred embodiment of the present invention.

FIG. 3 shows an embodiment of an electrode structure for providing the above-described sections. The structure provides a plurality of electrode segments 6 arranged axially along the path that the ions travel. Acceleration regions 8 are defined between each adjacent pair of electrode segments 6. Each segment may comprise a multipole rod set or a cylindrical or apertured electrode through which the ions travel. Alternate segments are connected to different phases of an RF voltage source 10, preferably to opposite phases of the voltage source 10. As such, the potential applied to a given electrode segment 6 may be timed so as to rise whilst ions of interest are within that segment 6. For example, the RF potential of the first segment 6*a* may rise whilst ions of interest are within that axial segment. As the ions of interest exit the first axial segment 6*a* they are accelerated towards the second axial segment 6*b* by the potential difference that is arranged between the adjacent segments 6*a*,6*b* due to the opposing phases of the RF voltage being applied to the adjacent segments. Once the ions of interest are within the second axial segment 6*b* the RF potential applied to that segment may increase. As the ions exit the second axial segment 6*b* the ions are again accelerated by the potential difference between the second and third axial segments 6*b*,6*c*, resulting from different RF phases being applied to the second and third axial segments. This acceleration process may be repeated between further axial segments 6 or between all adjacent pairs of axial segments 6.

It will be appreciated that each time the ions of interest are accelerated between axial segments 6, these ions will pass through the next axial segment at a higher speed than they passed through the previous axial segment. The length of each axial segment 6 following an acceleration region 8 is therefore preferably made longer than the axial segment 6 preceding that acceleration region 8. This ensures that the ions exit the axial segment 6 that follows an acceleration region 8 at the correct time to be accelerated by the potential difference applied by the RF voltage supply 10 between the following axial segment and the next axial segment. If all of the axial segments 6 had the same length then as the ions of interest increased in speed they would exit an axial segment 6 too early, before an accelerating RF potential difference is arranged between the axial segment that the ions exit and the next axial segment. This might even cause the ions to be decelerated if the potential difference at the time of exit resulted in a decelerating field. It will be seen from the embodiment of FIG. 3 that eleven acceleration regions 8 are provided between twelve axial segments 6 and these axial segments progressively increase in length. It will be appreciated that any number of axial segments 6 and acceleration regions 8 may be provided.

The frequency of the RF voltage supply 10 may be selected based on the mass to charge ratio of the ions of interest. Ions of lower mass to charge ratio will move through the device faster and will require a higher frequency RF voltage to be applied to the segments 6 in order to drive these ions through the device, whilst ions of higher mass to charge ratio will move through the device slower and will require a lower frequency RF voltage to be applied to the segments 6 in order to drive these ions though the device.

In a non-illustrated embodiment the axial segments 6 may have the same length and the geometric locations of the acceleration regions 8 may be equally spaced along the axial path for ease of construction. In such an embodiment, the frequency of the RF voltage 10 applied to the axial segments 6 increases with time of flight of the ions through the system, or the RF frequency applied to the axial segments 6 increases along the length of the device, such that the ions of interest are chased along the device.

It is contemplated that the axial segments 6 may be multipole rod sets, such as quadrupole rod sets. This enables the device to radially focus ions as well as accelerate the ions axially, for any given mass to charge ratio. RF voltages are applied to the electrode(s) of each axial segment in order to radially confine ions. Preferably, different phases of an RF voltage supply are applied to different electrodes of each axial segment 6 so as to radially confine the ions. For example, each axial segment may be a quadrupole rod set and one pair of opposing rods may be connected to a first phase of the RF voltage and the other pair of opposing rods may be connected to another phase of the RF voltage supply, preferably to the opposite phase.

The application of the RF voltage 10 to accelerate ions axially, and especially scanning of this RF voltage 10 in order to accelerate ions of different mass to charge ratios, may cause many ions to be lost. Some ions are lost because only ions in a certain range of mass to charge ratios will be synchronised with the RF voltage such that they continue to arrive at the next acceleration region 8 at a time when an accelerating potential difference is arranged across that acceleration region 8. Some ions therefore become out of phase with the RF voltage 10 and do not reach the acceleration regions 8 at the correct times to be accelerated. This may cause the sensitivity of the device to be relatively low. In order to recover these ions that are not carried through the device by the RF voltage and to increase the sensitivity of the device, a DC retarding field may be applied axially along the device so that the ions that are out-of-phase with the RF voltage 10 and that are not accelerated out of the device are forced back towards the entrance of the device for later analysis.

Figure 4:
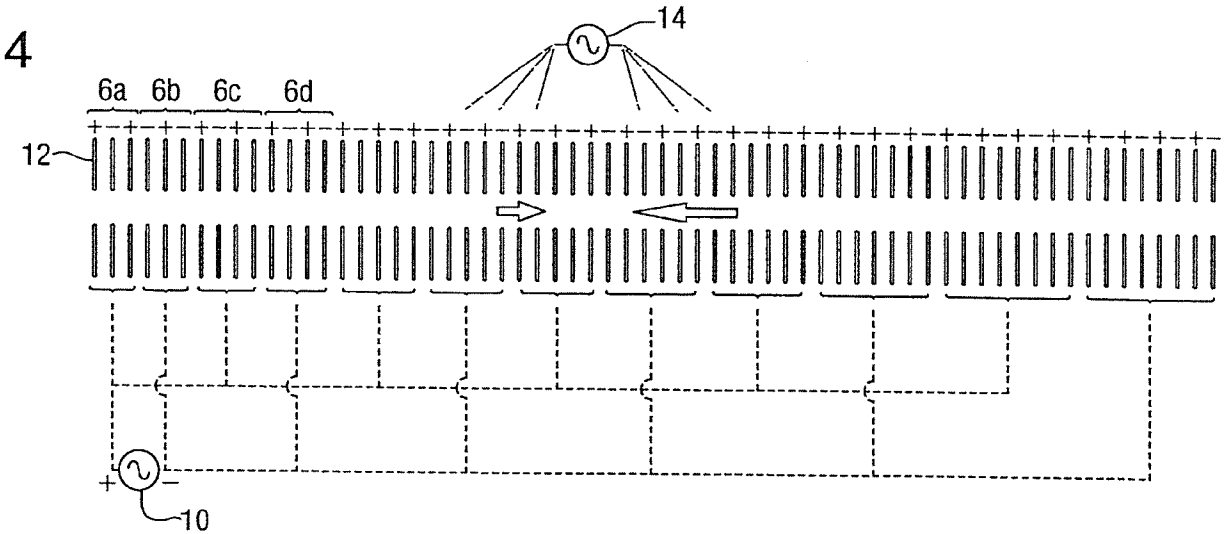
FIG. 4 is a schematic of the electrode structure of another preferred embodiment of the present invention.

FIG. 4 shows a preferred embodiment that is similar to that of FIG. 3, wherein each axial segment 6 is formed from a plurality of electrodes 12 having apertures therethrough. Different phases of an RF voltage supply 14, preferably opposing phases, are applied to adjacent apertured electrodes 12 such that ions are radially confined by the electrodes 12 and can travel along the axis of the device through the apertures. A bath gas may be utilized in this embodiment to help improve the radial confinement of ions. A second RF voltage supply 10 is used to define the positions of the axial segments 6 and acceleration regions 8. In this embodiment, a first phase of the second RF voltage supply 10 is applied to the first three apertured electrodes 12 so as to define a first axial segment 6*a*. A second, preferably opposite, phase of the second RF voltage supply 10 is applied to the next three apertured electrodes 12 so as to define a second axial segment 6*b*. The first phase of the second RF voltage supply 10 is applied to the next four apertured electrodes 12 so as to define a third axial segment 6*c*. The second phase of the second RF voltage supply 10 is applied to the next four apertured electrodes 12 so as to define a fourth axial segment 6*d*. This pattern continues along the device to define the various axial segments 6. The acceleration regions 8 are defined between each pair of adjacent axial segments 6 and operate as described in relation to FIG. 3. This causes the ions of interest to be accelerated in the direction represented in FIG. 4 by the arrow directed towards the right of the device. Also, as described above in relation to FIG. 3, the length of each axial segment 6 may become progressively longer to reflect the increasing speed that the ions of interest travel at as they pass through the device. The length of any given axial segment 6 can be easily selected by applying any given phase of the second RF voltage supply 10 to a selected number of adjacent apertured electrodes 12.

As described above, some ions become out of phase with the RF axial acceleration voltage 10 and do not reach the acceleration regions 8 at the correct times to be accelerated. In this embodiment, a DC retarding field may be applied axially along the device so that ions that are out-of-phase with the RF axial acceleration voltage 10 are driven back to the beginning of the device. This DC field is represented in FIG. 4 by the arrow directed towards the left of the device. The DC field may be arranged by applying different DC voltages to the electrodes 12 of different axial segments 6. Different DC voltages may also be applied to different electrodes 12 within each axial segment 6 in order to arrange the DC field along the device.

Figure 5:
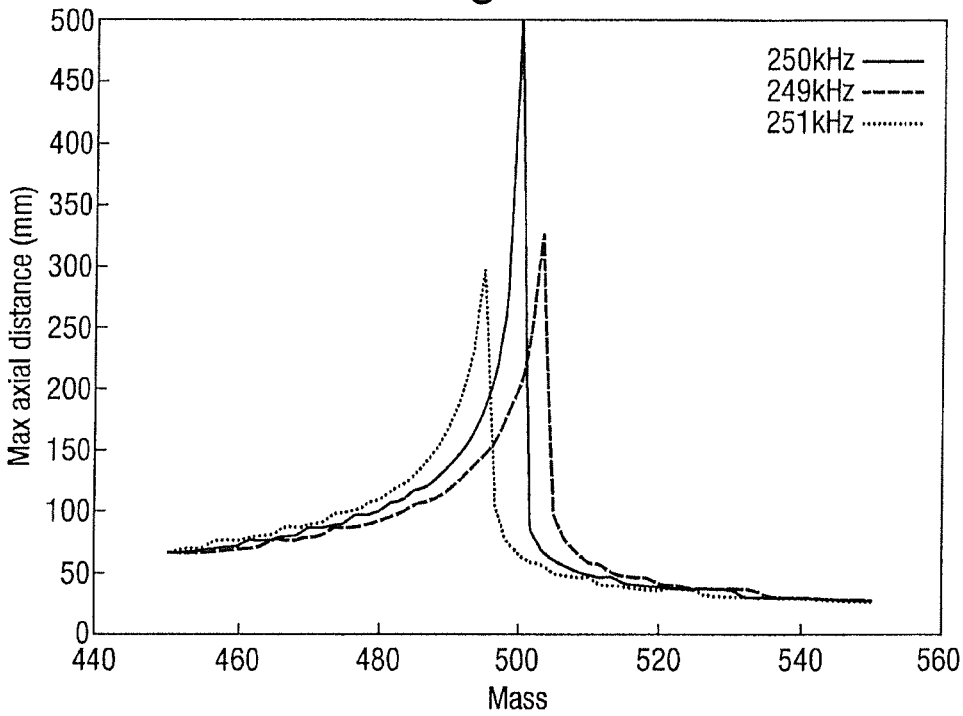
FIG. 5 depicts the axial distance travelled by ions in the embodiment of FIG. 4 as a function of mass to charge ratio of the ions.

FIG. 5 depicts the axial distance travelled by ions through a device of a preferred embodiment as a function of mass to charge ratio of the ions. The data is from a SIMION model in which the device is considered to be periodic, with 5 mm sections of RF field followed by 5 mm sections of DC retarding field. The model parameters were entered such that the RF acceleration voltage supply had a frequency of 250 kHz, i.e. tuned for ions having a mass to charge ratio of 500. This RF voltage supply was considered to be a sinusoidal pulse having a peak field of −4359 V/m. The ions were considered to be initially at phase zero with a kinetic energy of 10 eV. This results in ions having a mass of 500 travelling 5 mm along the device during half of an RF phase. In this example, the retarding DC field then reduces these ions back to having their initial velocity over the next 5 mm and during the same amount of time. As the kinetic energy gain over the first 5 mm region ($d_1$) is 2 $Vd_1$/pi, it may be desired that the potential difference over the next 5 mm region $d_2$ restores the ions back to their initial kinetic energy. In this special solution, as the ions are restored to their initial kinetic energy over one full acceleration/deceleration cycle there is no net change in velocity for these ions. These ions therefore reach the next acceleration region at the correct time to be accelerated and so continue to be propagated through the device. FIG. 5 shows that these ions having a mass of 500 are propagated a large axial distance through the device. Ions of other masses do not propagate through the device so as to continually arrive at the acceleration regions at the correct times to continue to be driven through the device. The maximum distance that these ions propagate through the device is therefore lower than that of ions having a mass of 500.

Similarly, when the frequency of the RF voltage supply is altered, ions having a mass of 500 do not propagate through the device so as to arrive at the acceleration regions at the correct times to continue to be driven through the device. FIG. 5 shows that when the frequency of the RF voltage supply is tuned from 250 kHz to either 249 kHz or 251 kHz, then the maximum distance that an ion of any given mass will propagate through the device changes. It is therefore apparent that the maximum propagation distance though the device varies as a function of ion mass and also as a function of the frequency of the RF voltage supply. It will therefore be appreciated that the ions can be filtered and ions of desired mass can be caused to move to a desired portion of the device or leave the device by tuning the frequency of the RF voltage supply.

Figure 6:
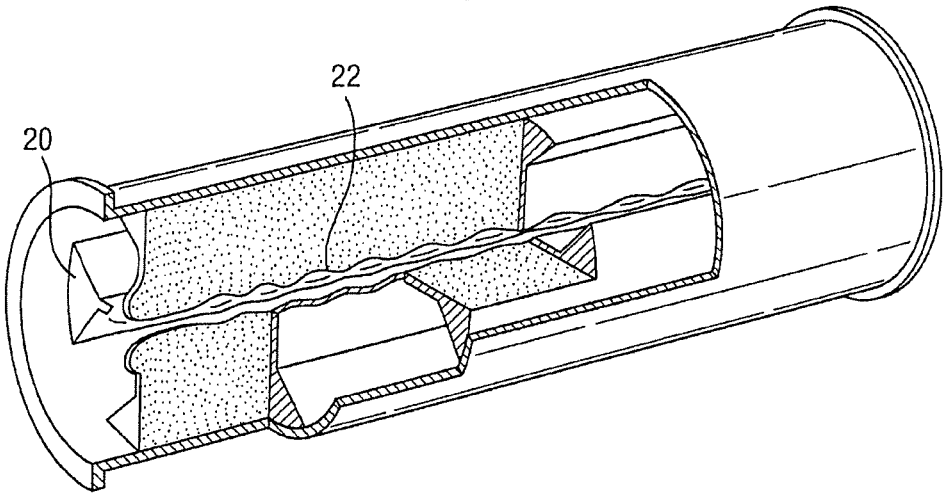
FIG. 6 is a schematic of the electrode structure of another embodiment of the present invention.

FIG. 6 shows an alternative embodiment to the stacked ring ion guide described above in relation to FIG. 4. In this embodiment the device comprises a quadrupole rod set 20 to which RF potentials are applied so as to radially confine the ions. Each rod of the rod set comprises sinusoidal shaped accelerating vanes 22 for axially accelerating the ions. If it is desired to provide a DC retarding field, as described above in relation to FIG. 4, then the rod set may be axially segmented so that different DC potentials can be applied to different axial segments to generate the DC retarding field.

Although the present invention has been described with reference to preferred embodiments, it will be understood by those skilled in the art that various changes in form and detail may be made without departing from the scope of the invention as set forth in the accompanying claims.

For example, it will also be understood that the invention is applicable to linear time of flight systems with no reflectron or ion mirror.

It is also contemplated that although the geometries described above are linear, the acceleration regions could be disposed in a non-linear array, such as in a circular array. For example, a circular cyclotron device could be employed to increase the energy of ions.

It will be appreciated that various different types of mass spectrometers would benefit from the present invention. For example, the present invention is particularly beneficial in quadrupole orthogonal acceleration TOF systems and in axial MALDI-TOF systems, although other types of mass spectrometers and detectors could be employed.

It is also contemplated that the methods described herein may be used within mass spectrometers to increase the kinetic energy of precursor ions prior to collisionally induced dissociation (CID) in a gas filled collision cell or prior to surface induced dissociation (SID). The resulting daughter ions may then be mass analysed in a mass analyser, e.g. in a TOF.

The invention claimed is:

1. A method of mass spectrometry comprising:

providing a flight region for ions to travel through and a fragmentation device;

maintaining a potential profile along the flight region such that parent or precursor ions travel towards the fragmentation device; and changing the potential at which a first length of the flight region is maintained from a first potential to a second potential whilst at least some of said ions are travelling within said length of flight region, the changed potential providing a first potential difference at an exit of said length of flight region, whereby said at least some ions are accelerated through the potential difference as they leave said length of flight region and such that the ions reach the fragmentation device with increased energy and fragment therein.

2. The method of claim 1, wherein the fragmentation device is a gas filled collision cell or a device for enabling surface induced dissociation.

3. The method of claim 1, wherein the potential at which the first length of flight region is maintained is changed relative to a potential at which the fragmentation device is maintained so as to provide said potential difference between said first length and said fragmentation device.

4. The method of claim 1, wherein the potential at which the first length of flight region is maintained is changed relative to the potential at which a second downstream length of said flight region is maintained so as to provide said potential difference between said first and second lengths of flight region.

5. The method of claim 1, wherein the potential of the first length of flight region is varied with time such that the potential difference is set to be relatively small or no potential difference whilst ions of relatively low mass to charge ratio pass through and exit the first length of flight region, and such that the potential difference is set to be relatively high when ions of relatively high mass to charge ratio pass through and exit the first length of flight region.

6. The method of claim 1, comprising changing the potential at which the first length of flight region is maintained from the second potential to a third potential whilst ions are travelling within said first length of flight region, the changed potential providing a second potential difference at an exit of said first length of flight region, whereby ions are accelerated through the second potential difference as they leave the first length of flight region.

7. The method claim 1, comprising changing the potential at which a further length of the flight region is maintained whilst at least some ions are travelling within said further length of flight region, the further length being in a different axial position of the flight region to the first length of flight region, the changed potential resulting in a further potential difference being arranged at the exit of said further length of flight region, whereby at least some ions are accelerated through the further potential difference as they leave said further length of flight region.

8. The method of claim 7, wherein the timings at which the potentials applied to the first and further lengths of flight region are changed are selected such that the ions accelerated by the first potential difference at the exit of the first length of flight region are different to the ions that are accelerated by the further potential difference at the exit of the further length of flight region.

9. A mass spectrometer comprising:

a flight region for ions to travel through in use;

a fragmentation device; and controller arranged and adapted to:

maintain a potential profile along the flight region such that, in use, parent or precursor ions travel towards the fragmentation device; and change the potential at which a first length of the flight region is maintained from a first potential to a second potential whilst at least some of said ions are travelling within said length of flight region, the changed potential providing a first potential difference at an exit of said length of flight region, whereby said at least some ions are accelerated through the potential difference as they leave said length of flight region and such that the ions reach the fragmentation device with increased energy and fragment therein.

10. A method of mass spectrometry comprising:

providing first, second and third lengths of flight region having a first acceleration region between the first and second lengths of flight region and a second acceleration region between the second and third lengths of flight region;

applying a first phase of an RF voltage supply to one or more electrodes of the first length of flight region, applying a second phase of the RF voltage supply to one or more electrodes of the second length of flight region, and applying the first or a third phase of the RF voltage supply to one or more electrodes of the third length of flight region such that whilst ions of interest are travelling within the first length of flight region the potential of the first length of flight region is increased and said ions exit the first length of flight region whilst the RF voltage supply provides a potential difference between the first and second lengths of flight region so as to cause the ions to be accelerated through the first acceleration region and into the second length of flight region, and such that whilst the ions of interest are travelling within the second length of flight region the potential of the second length of flight region is increased by the RF voltage supply and the ions exit the second length of flight region when the RF voltage supply provides a potential difference between the second and third lengths of flight region so as to cause the ions of interest to be accelerated through the second acceleration region and into the third length of flight region.

11. The method of claim 10, comprising selecting the frequency of the RF voltage supply based on the mass to charge ratio of ions of interest.

12. The method of claim 10, comprising varying the frequency of the RF voltage supply with time so as to transmit different ions of interest at different times.

13. The method of claim 10, wherein the first length of flight region is defined by a first plurality of electrodes, and wherein the RF voltage supply supplies the same potential to all of the first plurality of electrodes at any given time.

14. The method of claim 10, wherein the second length of flight region is defined by a second plurality of electrodes, and wherein the RF voltage supply supplies the same potential to all of the second plurality of electrodes at any given time.

15. The method of claim 10, wherein axially spaced electrodes are arranged along the axial length of the flight region and DC potentials are applied to these electrodes so as to create a DC axial field that exerts a force on ions in an axial direction that is opposite to the direction in which the ions are accelerated by the RF voltage supply.

16. The method of claim 15, wherein the RF voltage supply drives said ions of interest in one direction, and wherein ions having other mass to charge ratios are driven in another direction by the DC axial field.

17. The method of claim 10, comprising increasing the frequency of the RF voltage supply with time as the ions travel downstream.

18. The method of claim 10, wherein the frequency of the RF voltage applied to the one or more electrode of the second flight region is higher than the frequency of the RF voltage applied to the one or more electrode of the first flight region and/or wherein the frequency of the RF voltage applied to the one or more electrode of the third flight region is higher than the frequency of the RF voltage applied to the one or more electrode of the second flight region.

19. The method of claim 10, comprising radially confining the ions using a second RF voltage supply.

20. A mass spectrometer comprising:

first, second and third lengths of flight region, a first acceleration region arranged between the first and second lengths of flight region and a second acceleration region arranged between the second and third lengths of flight region;

an RF voltage supply arranged and configured so as to apply a first phase of the RF voltage supply to one or more electrodes of the first length of flight region, a second phase of the RF voltage supply to one or more electrodes of the second length of flight region, and to apply the first or a third phase of the RF voltage supply to one or more electrodes of the third length of flight region such that, in use, whilst ions of interest are travelling within the first length of flight region the potential of the first length of flight region is increased and said ions exit the first length of flight region whilst the RF voltage supply provides a potential difference between the first and second lengths of flight region so as to cause the ions to be accelerated through the first acceleration region and into the second length of flight region, and whilst the ions of interest are travelling within the second length of flight region the potential of the second length of flight region is increased by the RF voltage supply and the ions exit the second length of flight region when the RF voltage supply provides a potential difference between the second and third lengths of flight region so as to cause the ions of interest to be accelerated through the second acceleration region and into the third length of flight region.

* * * * *